US005538084A

United States Patent [19]

Nakayama et al.

[11] Patent Number: 5,538,084

[45] Date of Patent: Jul. 23, 1996

[54] DEVICE FOR CONTROLLING HEIGHT OF BLADE OF TRACKED VECHICLE

[75] Inventors: Tetsuya Nakayama; Toshihiko Kohda; Tatsuro Nakazato, all of Kanagawa, Japan

[73] Assignee: Kabushiki Kaisha Komatsu Seisakusho, Tokyo, Japan

[21] Appl. No.: 420,753

[22] Filed: Apr. 12, 1995

Related U.S. Application Data

[63] Continuation of Ser. No. 949,475, filed as PCT/JP91/00553, Apr. 24, 1991, abandoned.

[30] Foreign Application Priority Data

Apr. 24, 1990 [JP] Japan ..... 2-107851
Apr. 24, 1990 [JP] Japan ..... 2-107852

[51] Int. Cl.[6] ..... E02F 3/76; A01B 63/111

[52] U.S. Cl. ..... 172/4.5; 172/2

[58] Field of Search ..... 172/4, 4.5, 2; 37/348, 37/382, 907; 364/424.07

[56] References Cited

U.S. PATENT DOCUMENTS 4,273,196 6/1981 Etsusaki et al. ..... 172/4.5
4,343,365 8/1982 Rajagopal et al. ..... 172/4

*Primary Examiner*—Peter Nerbun
*Attorney, Agent, or Firm*—Baker & Daniels

[57] ABSTRACT

A device for improving the workability and drivability of a tracked vehicle whose blade height is automatically controlled, in which when changeover of a speed step from reverse to forward is detected by a transmission lever position detector (3), a controller (15) controls to raise or lower the blade (8) to a target value which is the height of the blade (8) initially set by an initial height setter (4). With a blade raising lever (1) operated, the blade (8) is controlled to rise or lower in proportion to the height of the blade during manual operation. The height is detected by a blade-height detector (14) and the blade is controlled to rise or lower to a target value which is the detected value of height.

3 Claims, 3 Drawing Sheets

DEVICE FOR CONTROLLING HEIGHT OF BLADE OF TRACKED VECHICLE

This is a continuation of application Ser. No. 07/949,475 filed on Oct. 22, 1992, and now abandoned, filed as PCT/JP91/00553, filed on Apr. 24, 1991.

TECHNICAL FIELD

The present invention relates generally to a tracked vehicle such as a bulldozer, a tractor, a dozer shovel or the like. More particularly, the present invention relates to a blade height controlling device for a tracked vehicle capable of automatically maintaining the blade height constant.

BACKGROUND ART

When a ground levelling operation is performed by a conventional tracked vehicle such as a bulldozer or the like, the vehicle is usually required to repeat forward/rearward movement several times. That is, while a blade is raised up to a desired height, it moves in the forward direction to push away soil, gravel or the like with the blade, thereafter, it once moves in the rearward direction, and subsequently, it moves in the forward direction again.

To easily perform ground levelling operation as mentioned above, many of the recently manufactured tracked vehicles have a function of automatically controlling the blade to a certain set height. Once an operator sets the blade height to a desired value by a blade height setting dial, the blade is automatically raised or lowered so as to allow the set blade height to be continuously maintained during the ground levelling operation.

When it is desired to change the set blade height in the course of the automatic blade height control, the operator operates a blade raising lever. The operation of the blade raising lever has priority over other operations.

In the conventional device of the foregoing type, however, when the blade height is manually changed in the course of the automatic blade height control by operating the blade raising lever, and thereafter, the blade height is subjected to automatic controlling again, the subsequent ground levelling operation is performed with the originally set blade height. As a result, in the conventional device, a stepped part appears in the region corresponding to the manual blade height control as shown in FIG. 3.

To perform a desired ground levelling operation as represented by a broken line in FIG. 3 having no stepped part, the conventional device requires such complicated operations that after shifting to the manual operation, the blade raising lever is continuously operated until the ground levelling operation is completed or the blade height setting dial is adjusted again after the completion of the manual operation.

DISCLOSURE OF THE INVENTION

According to one aspect of the present invention, there is provided a device for controlling height of a blade of a tracked vehicle, comprising an electrical lever for generating a blade raising command signal to raise or lower the blade, blade height setting means for setting and storing the height of the blade, blade height detecting means for detecting the height of the blade, operation detecting means for detecting the operation of the electrical lever, speed stage shift detecting means for detecting that the speed stage is shifted from rearward movement stage to forward movement stage, selecting means for selecting a value set by the blade height setting means when a detection signal is output from the speed stage shift detecting means in the course of automatic blade height control, and selecting a value detected by the blade height detecting means when a detection signal is output from the operation detecting means after the value set by the blade height setting means is selected, memory means for temporarily storing an output from the selecting means, switching means for switching a value stored in the memory means and a blade raising command signal generated by the electrical lever in response to the detection signal output from the operation detecting means, and drive controlling means for controlling a blade raising actuator in response to an output from the switching means, wherein the automatic blade height control after outputting of the detection signal from the operation, detecting means is performed by using a final value among the values detected by the blade height detecting means and stored in the memory means as a target value, According to this aspect of the present invention, when it is instructed that automatic controlling is started, by shifting the present speed stage from rearward movement to forward movement, so as to allow the blade to be held at a constant height, a value set for the blade by an operator is stored in the memory means as a set value for automatically controlling the blade height.

Since no detection signal is output from the operation detecting means during the automatic controlling, the switching means selects the value stored in the memory means with the result that the blade is automatically raised or lowered in accordance with the set value stored in the memory means. When the electrical lever is operated in the course of the automatic controlling, the content stored in the memory means is updated based on the value detected for the blade height. During a period when the electrical lever is manually operated, the content stored in the memory means is continuously updated based on the value detected for current blade height. During the manual operation, the switching means selects the blade raising command signal from the electrical lever in response to the detection signal output from the operation detecting means. Thus, the blade is driven in the manual operation during this period. On completion of the manual operation, the data corresponding to the final command for the manual operation are stored in the memory means, and thereafter, automatic control is executed for the blade height while the final command for the manual operation stored in the memory means is utilized as a target value for the height of the blade.

Further, according to another aspect of the present invention, there is provided a device for controlling height of a blade of a tracked vehicle, comprising blade height setting means for setting and storing the height of the blade, blade height detecting means for detecting the height of the blade, operation detecting means for detecting the operation of a blade raising lever, speed stage shift detecting means for detecting that the speed stage is shifted from rearward movement stage to forward movement stage, selecting means for selecting a value set by the blade height setting means when a detection signal is output from the speed stage shift detecting means in the course of automatic blade height control, and selecting a value detected by the blade height detecting means when a detection signal is output from the operation detecting means after the value set by the blade height setting means is selected, memory means for temporarily storing an output from the selecting means, switching means for switching a value stored in the memory means and a blade raising command signal generated by the electrical lever in response to the detection signal output from the operation detecting means, and drive controlling means for controlling a blade raising actuator such that deviation between a target value and a detection value of the blade height detecting means becomes zero by using the data stored in the memory means as the target value, wherein the automatic blade height control after outputting of the detection signal from the operation detecting means is performed by using a final value among the values detected by the blade height detecting means and stored in the memory means as a target value.

According to this aspect of the present invention, when it is instructed that automatic controlling is started, by shifting the present speed stage from rearward movement to forward movement, so as to allow the blade to be held at a constant height, a value set for the blade height by an operator is stored in the memory means as a set value for automatically controlling the blade height, whereby the blade is automatically raised or lowered in accordance with the set value. When the blade raising lever is operated in the course of the automatic controlling, the content stored in the storing means is updated based on the value detected for the current blade height. During the manual operation of the blade raising lever, the content stored in the memory means is continuously updated based on the value detected for current blade height, whereby the blade is driven in conformity with manual operation. On completion of the manual operation, the data corresponding to a final command for the manual operation are stored in the memory means, and thereafter, automatic controlling is executed for the blade height while the final command for the manual operation stored and stored in the memory means are utilized as a target value.

BEST MODE FOR CARRYING OUT THE INVENTION

Figure 1:
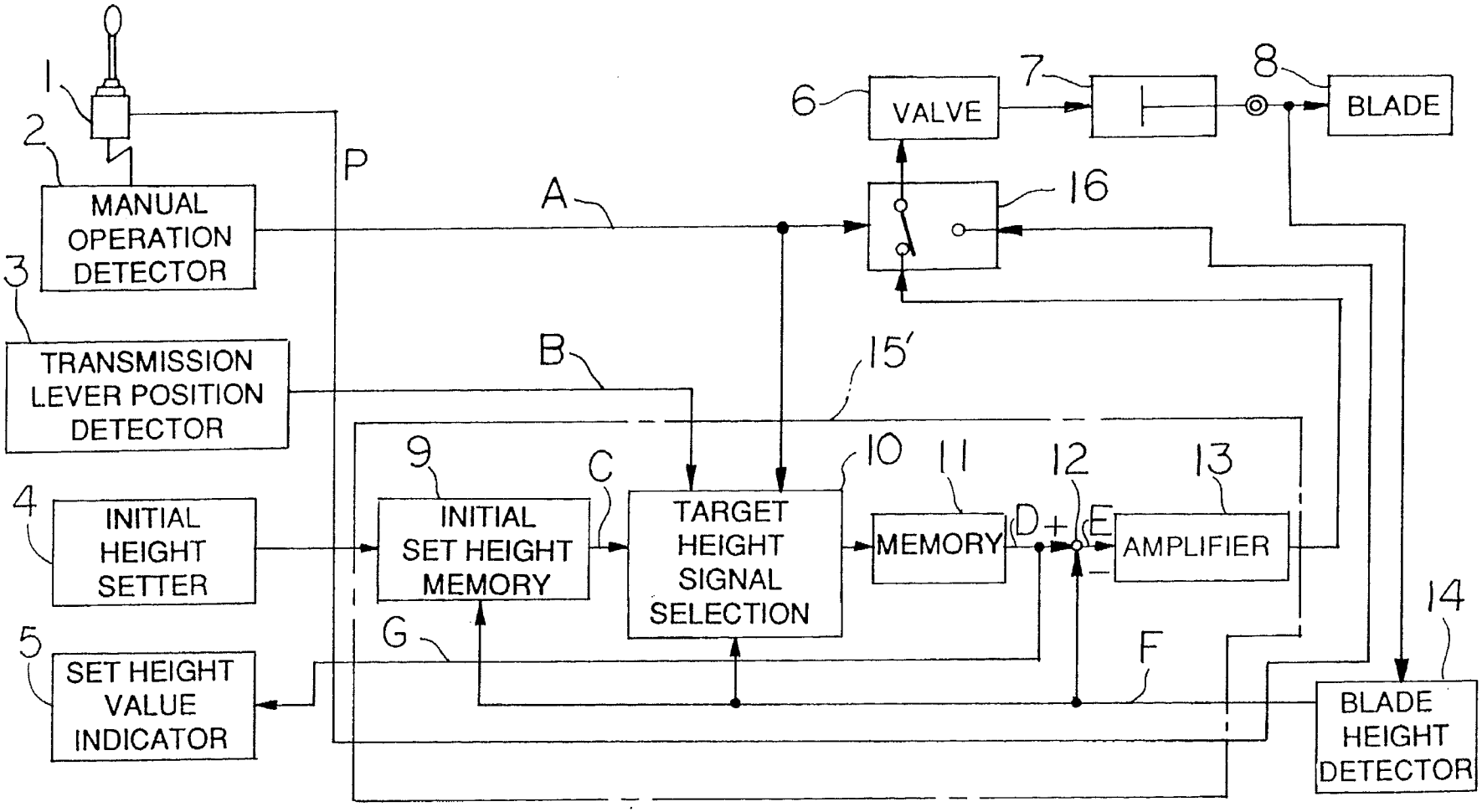
FIG. 1 is a block diagram which schematically illustrates the structure of a device for controlling a height of a blade mounted on a tracked vehicle in accordance with a first embodiment of the present invention.

FIG. 1 illustrates by way of block diagram the structure of a device for controlling height of a blade of a tracked vehicle in accordance with a first embodiment of the present invention. The device includes a blade raising lever 1 in the form of a so-called electrical lever and a potentiometer for detecting displacement of the lever 1. A detection signal P output from the potentiometer is input into a controller 15 as a command signal for raising or lowering the blade, and it is then input into a shift switch 16 via the controller 15. A manual operation detector 2 detects that the blade raising lever 1 is practically operated, and a detection signal A output from the manual operation detector 2 is input into a target height signal selecting part 10 in the controller 15. In practice, the manual operation detector 2 detects manual operation of the lever 1 by detecting that the lever 1 is displaced from its neutral position in response to an output from the potentiometer for the lever 1.

A transmission lever position detector 3 detects that the present speed stage is shifted to forward movement of the vehicle from rearward movement, and a detection signal B output from the transmission lever position detector 3 is input into the target height signal selecting Dart 10 in the controller 15.

A blade-height detector 14 detects the present height of a blade 8, and a detection value F derived from the detection of the blade-height detector 14 is input into an initial set height memory 9, the target height signal selecting Dart 10 and a subtractor 12.

An initial height setter 4 serves as an operation switch for inputting a writable enabling signal into the initial set height memory 9, and a detection value derived from the detection of the blade-height detector 14 when the foregoing operation switch is turned on is stored in the initial set height memory 9. Incidentally, if the initial height setter 4 is constructed in the form of a rotary type or a keyboard type digital switch so as to allow a blade height command value to be output from the digital switch, the initial set height memory 9 is not required any more (because the digital switch has a data holding function), and it becomes unnecessary that the output F from the blade-height detector 14 is input into the initial set height memory 9.

The target height signal selecting Dart 10 operates such that when the detection signal B output from the transmission lever position detector 3 is input, a blade height set value C stored in the initial set height memory 9 is selected, and when the detection signal A detected by the manual operation detector 2 is input, the detection value F from the blade-height detector 14 is selected so as to allow an output derived from the foregoing selection to be stored in a memory 11. Incidentally, the target height signal selecting part 10 operates such that the output C from the initial set height memory 9 is received and stored in the memory 11 in response to an output of the detection signal B, and the detection value F which appears when a detection signal A from the manual operation detector 2 is kept ON is received so as to allow the content D stored in the memory 11 to be updated. The content D stored in the memory 11 is output to a set height value indicator 5 so that it is indicated at the indicator. The subtractor 12 calculates a deviation E of the data D stored in the memory 11 from the detection output F from the blade-height detector 14, and the thus calculated deviation E is then input into the shift switch 16 via an error amplifier 13.

In response to the detection signal A output from the manual operation detector 2, the shift switch 16 selectively switches the output P from the blade raising lever 1 to the output from the amplifier 13. Specifically, when the detection signal A is turned on, the shift switch 16 selects the output P from the blade raising lever 1, and when the detection signal A is turned off, it selects the output from the amplifier 13. An output from the shift switch 16 is input into a solenoid in an operation valve 6.

The operation valve 6 operates to supply pressurized hydraulic oil to a blade raising cylinder 7, causing the latter to be expanded or contracted, whereby the blade 8 is raised or lowered.

With the device constructed in the above-described manner, when it is assumed that an operator operates a transmission (T/M) lever from rearward movement to forward movement, a initial set command B s input into the target height signal selecting Dart 10 in the controller 15 from a transmission (T/M) lever position detector 3.

Subsequently, the set value C stored in the initial set height memory 9 to represent the present height of the blade is received in the target height signal selecting part. 10, and thereafter, it is transmitted to the memory 11 in which it is stored. Since the detection signal A from the manual operation detector 2 is turned off at this time, when a ground levelling operation is started by forward movement of a bulldozer while the foregoing state is maintained, the blade 8 is automatically raised or lowered so as to allow the deviation E of the set value C stored in the memory 11 from the detection value F of the blade-height detector 14 to be reduced to a level of zero.

When it is assumed that the operator operates the blade raising lever 1 during the automatic controlling operation, this blade raising operation is detected by the manual operation detector 2 and the detection signal A is then input into the shift switch 16 and the target height signal selecting part 10 While the detection signal A is input in the above-described manner, the target height signal selecting part 10 successively receives the detection value F from the blade-height detector 14 so that the data stored in the memory 11 are successively updated based on the detection value F.

On receipt of the detection signal A, the shift switch 16 selects the command signal P output from the blade raising lever 1. Thus, in response to the command signal P, the blade 8 is raised or lowered, and the content stored in the memory 11 is continuously updated based on the detection value F from the blade-height detector 4. In addition, the height of the blade 9 is continuously indicated at the set height value indicator 5 during the manual operation.

On completion of the manual operation, the shift switch 16 is switched to the automatic side, i.e., the amplifier 13 side again, and thereafter, automatic raising operation of the blade 8 is restarted with the data finally stored in the memory 11 (the detection value F output from the blade-height detector 14 on completion of the manual operation) as a target value for the height of the blade 8.

Specifically, after the manual operation is completed, the detection value F representing the height of the blade 8 on completion of the manual operation is stored in the memory 11, whereby automatic control can be executed for the blade 8 after completion of the manual operation with the finally stored data as a target value for the height of the blade 8.

Thus, after the manual operation is completed for the blade 8 in the above-described manner, raising or lowering of the blade 8 is automatically executed while the final data stored in the memory 11 on completion of the manual operation are utilized as a target value for the height of the blade When it is assumed that the operator causes the bulldozer to move in the rearward direction on completion of a single step of operation and then shifts the transmission lever from rearward movement to forward movement again, the set value of the initial set height memory 9 is stored in the memory 11 again, and thereafter, automatic raising or lowering of the blade 8 is executed in the same manner as mentioned above with the stored data as a target value for the height of the blade 8.

After the manual operation is completed for the blade 8 in the above-described manner, raising or lowering of the blade 8 is automatically executed with the final data on completion of the manual operation as a target value for the height for the blade 8.

When it is assumed that the operator causes the bulldozer to move in the rearward direction on completion of a single step of operation and then shifts the transmission lever from rearward movement to forward direction again, the set value of the initial set height memory 9 is stored in the memory 11 again, and thereafter, automatic raising or lowering of the blade 8 is executed in the same manner as mentioned above with the stored data as a target value for the height of the blade 8.

When the automatic control is executed for the blade 8, the target value for the height of the blade 8 is indicated at the set height value indicator 5. On the other hand, when the manual operation is executed, the actual blade height corresponding to the manual operation is indicated at the set height value indicator 5.

Figure 2:
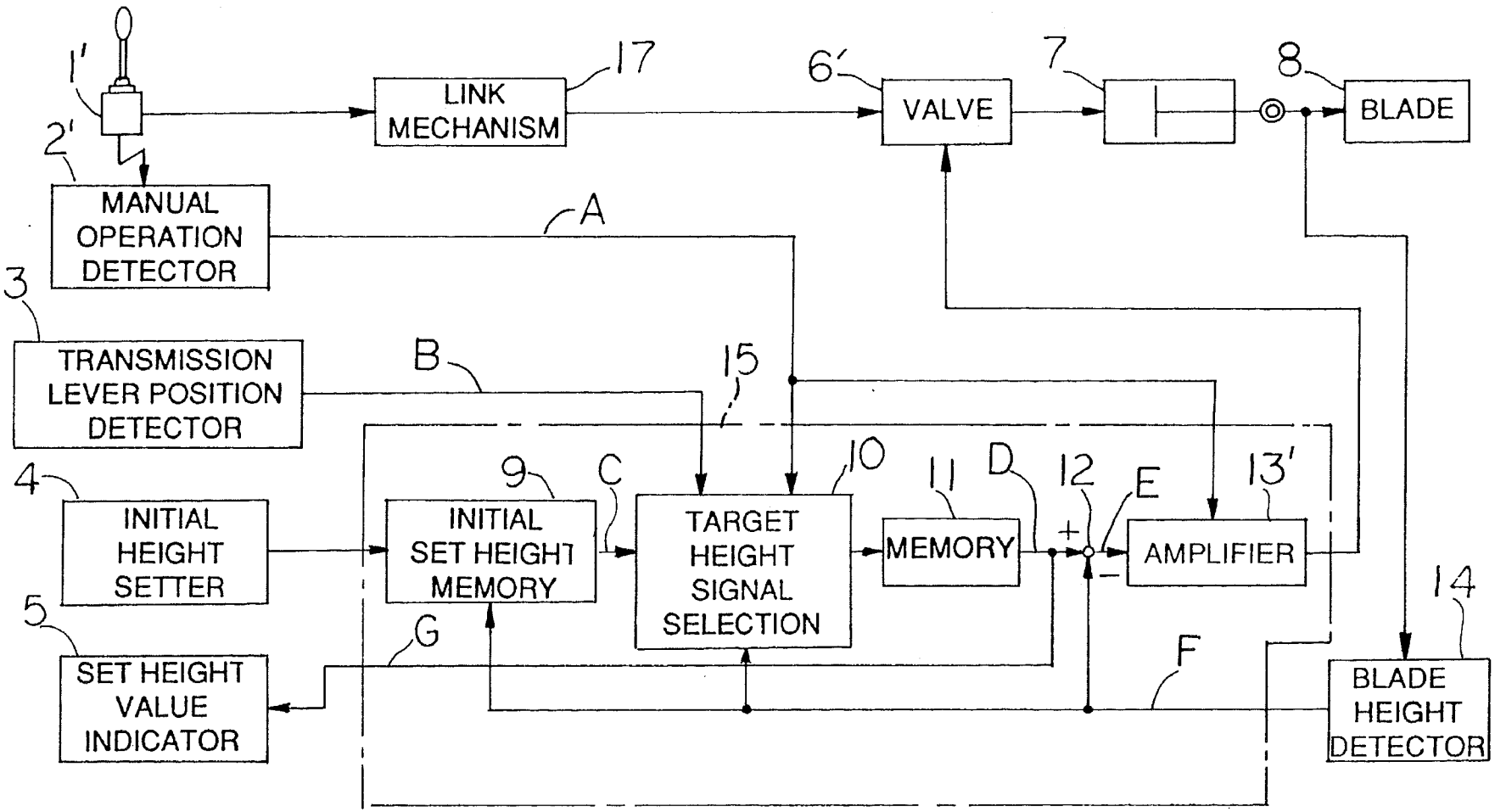
FIG. 2 is a block diagram which schematically illustrates the structure of a device of the foregoing type in accordance with a second embodiment of the present invention.
Figure 3:
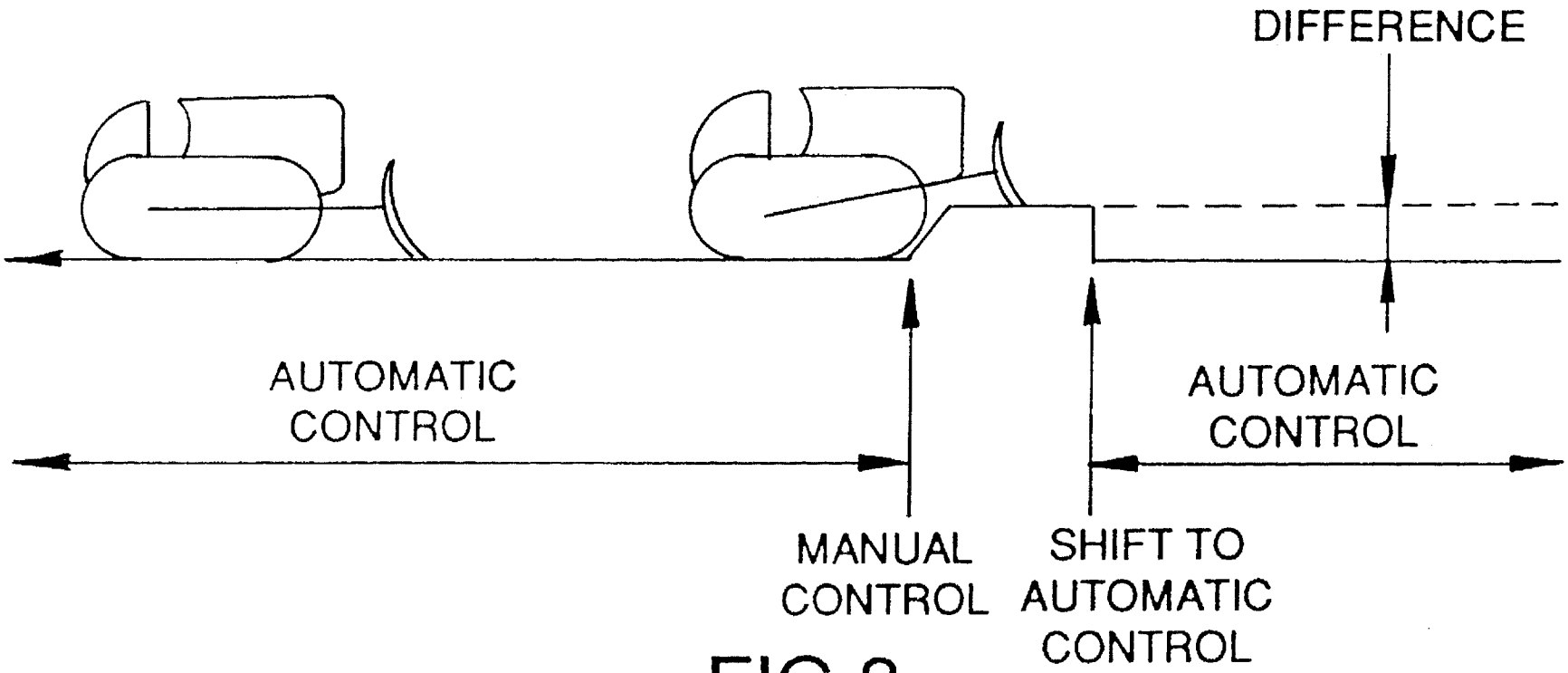
FIG.3 PRIOR ART
FIG. 3 is an illustrative view which schematically illustrates a malfunction arising with a conventional device of the foregoing type.

FIG. 2 illustrates by way of block diagram the structure of a device for controlling a height of a blade mounted on a tracked vehicle in accordance with a second embodiment of the present invention, and same components as those in the first embodiment are represented by same reference numerals. Thus, repeated description on these components is avoided.

In addition, a blade raising lever 1' is a mechanical lever connected mechanically directly to a link mechanism 17, and shifting of an operation valve 6' and flow rate controlling are performed via the link mechanism 17 corresponding to the displacement of the blade raising lever 1'. Pressurized hydraulic oil is supplied to a blade raising cylinder 7 via the operation valve 6' so that a blade 8 is raised or lowered by expanding or contracting the cylinder 7.

A manual operation detector 2' detects that the blade raising lever 1' is operated, and a detection signal A derived from the detection of the detector 2' is input into a target height signal selecting part 10 and an amplifier 13' in a controller 15'. Typical examples of the manual operation detector 2' will be noted below.

(1) A process of detecting manual operation wherein a push button switch is disposed on a knob of the blade raising lever 1' so that the manual operation is detected depending on ON/OFF of the push button switch under a condition that an instruction given by the lever 1' is valid only when the push button switch is depressed.

(2) A process wherein a touch sensor is disposed to detect depending on variation of an electrostatic capacity or the like that an operator touches the blade raising lever 1'.

(3) A process wherein a sensor is disposed to detect hat the blade raising lever 1' is displaced from a neutral position.

A subtractor 12 calculates deviation E of data D stored in a memory 11 from a detection output F from a blade-height detector 14, and the deviation E is then input into a solenoid in the operation valve 6' via the amplifier 13'

With the device constructed in the above-described manner, when it is assumed that the operator operates a transmission (T/M) lever from rearward movement to forward movement, an initial set command B is input into the target height signal selecting Dart 10 from a transmission (T/M) lever position detector 3.

Subsequently, a set value C stored in an initial set height memory 9 to represent the present height of the blade 8 is received in the target height signal selecting Dart 10, and thereafter, it is transmitted to the memory 11 in which it is stored. Thus, when a ground levelling operation is started by forward movement of the bulldozer, the blade 8 is automatically raised or lowered so as to allow the deviation E of the set value C stored in the memory 11 from the detection value F of the blade-height detector 14 to be educed to a level of zero.

When it is assumed that the operator operates the blade raising lever 1' during the automatic controlling operation, the operation valve 6' is driven via the link mechanism 17, whereby the blade 8 is raised or lowered to a height corresponding to the displacement of he blade raising lever 1'. On the other hand, the operation of the blade raising lever 1' is detected by a manual operation detector 2' so that a manual operation detection signal A is input into the target height signal selecting art 10. While the manual operation detecting signal A is input in that way, the detection value F of the blade-height detector 14 is successively received in the target height signal selection art 10, and thereafter, the data stored in the memory 11 are successively updated based on the detection value F.

While the manual operation is performed in that way, the operation valve 6' is driven merely by operating the blade raising lever 1' via the link mechanism 17 under a condition that any signal output from the amplifier 13' is inhibited in response to the manual operation detection signal A. In other words, while the manual operation is performed in the abovedescribed manner, the data stored in the memory 11 are output to a set height value indicator 5 so that they are indicated at the indicator. Thus, the blade 8 is not raised or lowered depending on the data stored in the memory 11.

After the manual operation is completed, automatic raising or lowering of the blade 8 is executed with the data finally stored in the memory 11 (the detection value F representing the height of the blade 8 on completion of the manual operation) as a target value for the height of the blade 8. Specifically, after the manual operation is completed, the detection value F representing the height of the blade 8 on completion of the manual operation is stored and stored in the memory 11, whereby automatic control can be executed for the blade 8 with the finally stored data as a target value for the height of the blade 8. Incidentally, when any manual operation detection signal A is not input into the controller 15, the amplifier 13' starts a signal outputting operation again and then operates to amplify an output from the subtractor 12 for the operation valve 7.

After the manual operation is completed for the blade 8 in the above-described manner, raising of the blade 8 is automatically executed while the final data obtained during the manual operation are utilized as a target value for the height of the blade 8.

When it is assumed that after completion of a single step of operation, the operator shifts the transmission lever from rearward movement to forward movement by causing the bulldozer to move in the rearward direction, the set value of the initial set height memory 9 is stored in the memory 11 again, and subsequently, automatic raising of the blade 8 is executed in the same manner as mentioned above while the data stored in the memory 11 are utilized as a target value for the height of the blade 8.

In the second embodiment of the present invention as mentioned above, it is suppressed that the blade 8 is driven in response to an electrical signal from the operation valve 6' by inhibiting any signal from being output from the amplifier 13' during the manual operation. Alternatively, the foregoing suppressing operation may be executed by employing any other arbitrary process. In addition, in the first and second embodiments of the present invention as mentioned above, it is detected that the present speed stage is shifted from rearward movement to forward movement, and thereafter, it is instructed based on the result derived from the foregoing detection that automatic control is started so as to allow the blade height to be kept constant. Alternatively, the foregoing instruction may be given by operating an ordinary manual operation switch.

INDUSTRIAL APPLICABILITY

As is apparent from the above description, according to the present invention, while manual operation is performed, a detection value representing the present height of a blade is received as a target value for the blade height so as to allow the blade to be held at a constant height, and after completion of the manual operation, the blade height is controlled while a final blade height in the course of the manual operation is utilized as a target value for the height of the blade. Thus, workability and drivability of a tracked vehicle in respect of automatic control for the blade height can be improved substantially.

What is claimed is:

1. A device for controlling height of a blade of a tracked vehicle, comprising:

a blade raising mechanical lever mechanically connected with a blade raising actuator, for driving the blade raising actuator;

initial blade height setting means for setting and storing an initial blade height;

blade height detecting means for detecting a current blade height;

manual operation detecting means for detecting the operation of the blade raising mechanical lever and for outputting an operation detection signal during a period when the lever is being operated;

transmission position detecting means for detecting that speed stage of a transmission is shifted from a rearward movement stage to a forward movement stage;

target blade height selecting means for selecting and outputting a blade height set by the initial blade height setting means as a target blade height when the transmission position detecting means detects that speed stage of the transmission is shifted from a rearward movement stage to a forward movement stage, and for selecting and outputting a blade height detected by the blade height detecting means as a target blade height in place of a value set by the initial blade height setting means when the manual operation detecting means outputs the operation detection signal;

memory means for temporarily storing an output of the target blade height selecting means;

blade raising command electric signal generating means for generating a blade raising command electric signal used for making the blade height to the target blade height stored in the memory means; and drive controlling means for inhibiting the blade raising command electric signal generated by the blade raising command electric signal generating means from being outputted when the operation detection signal is being outputted from the manual operation detecting means and for allowing the blade raising command electric signal generated by the blade raising command electric signal generating means to be outputted thereby controlling the blade raising actuator in accordance with the blade raising command electric signal outputted from the blade raising command electric signal generating means.

2. A device for controlling height of a blade of a tracked vehicle as claimed in claims 1, wherein the blade raising command electric signal generating means is a mechanical lever connected mechanically to the blade raising actuator and when the mechanical lever is operated, inputting of the data stored in the memory means into the blade raising actuator is inhibited.

3. A device for controlling height of a blade of a tracked vehicle as claimed in claim 1, further comprising means for indicating the data stored in the memory means.

* * * * *